US007603940B2

(12) United States Patent
Stellwagen

(10) Patent No.: US 7,603,940 B2
(45) Date of Patent: Oct. 20, 2009

(54) HYDRAULIC CONTROLLER ARRANGEMENT

(75) Inventor: Armin Stellwagen, Lohr (DE)

(73) Assignee: Bosch Rexroth AG, Stuttgart (DE)

( * ) Notice: Subject to any disclaimer, the term of this patent is extended or adjusted under 35 U.S.C. 154(b) by 503 days.

(21) Appl. No.: 10/581,336

(22) PCT Filed: Dec. 8, 2004

(86) PCT No.: PCT/DE2004/002705

§ 371 (c)(1),
(2), (4) Date: Jun. 13, 2006

(87) PCT Pub. No.: WO2005/057021

PCT Pub. Date: Jun. 23, 2005

(65) Prior Publication Data

US 2008/0282692 A1 Nov. 20, 2008

(30) Foreign Application Priority Data

Dec. 9, 2003 (DE) ..... 103 57 471

(51) Int. Cl.
*F15B 11/044* (2006.01)
*F15B 13/04* (2006.01)

(52) U.S. Cl. ..... 91/446; 91/517

(58) Field of Classification Search ..... 91/446, 91/452, 517, 532
See application file for complete search history.

(56) References Cited

U.S. PATENT DOCUMENTS

| | | | | | |
|---|---|---|---|---|---|
| 4,037,410 | A | * | 7/1977 | Jackson et al. | 60/445 |
| 5,203,678 | A | * | 4/1993 | Sugiyama et al. | 91/446 |
| 5,315,826 | A | * | 5/1994 | Hirata et al. | 91/446 |
| 6,148,856 | A | * | 11/2000 | Kropp | 91/446 |
| 6,644,025 | B1 | * | 11/2003 | Oberhausser et al. | 60/422 |

FOREIGN PATENT DOCUMENTS

| | | | | |
|---|---|---|---|---|
| DE | 33 41 641 | A1 | | 5/1985 |
| DE | 199 04 616 | A1 | | 8/2000 |
| EP | 0 516 864 | A1 | | 12/1992 |
| GB | 2149887 | A | * | 6/1985 |

* cited by examiner

*Primary Examiner*—Thomas E Lazo
(74) *Attorney, Agent, or Firm*—Oliff & Berridge, PLC

(57) ABSTRACT

What is disclosed is a hydraulic controller arrangement for the pressure medium supply of a hydraulic consumer, e.g., of the rotating gear of a mobile work machine. At low pressure medium flow rates, the pressure medium flow rate draining from the consumer is backed up by means of a drain backup valve having the form of a pressure limiting valve and throttled accordingly, so that a back pressure is generated which is capable of preventing an advance of the mass actuated by the hydraulic consumer.

9 Claims, 2 Drawing Sheets

HYDRAULIC CONTROLLER ARRANGEMENT

BACKGROUND OF THE INVENTION

1. Field of the Invention

The disclosure is directed to a hydraulic controller arrangement for the pressure medium supply of a hydraulic consumer whereby a load having a high mass may be moved.

2. Description of the Related Art

Hydraulic controller arrangements consist of a pump that adjusts depending upon the highest load pressure of the respective actuated hydraulic consumers such that the pump pressure exceeds the highest load pressure by a predetermined pressure difference. These are also referred to as LS ("Load-Sensing") systems. DE 199 04 616 A1 describes the basic principle of such LS controls.

Specifically, LS controls are used in situations where large masses are to be moved in a horizontal plane by means of the hydraulic consumers. An example of this is when the rotating gear drive mechanism of a mobile equipment and high pressures manifest during acceleration owing to the inertia of mass, which are, however, quickly reduced as soon as the mass has been set in motion. This can occur when the rotating gear has reached its desired rotational speed. It may result in a short-term advance of the mass, for example when the friction of the mass on the ground on which it is moving is very low. This advance of the mass is accompanied by an unintended modification of velocity. In hydraulic drive mechanisms including a controlled delivery quantity (LS control), this results in a pressure drop in the delivery line and in a deceleration of the mass, so that the latter has to be accelerated again in order to attain the desired velocity. Accordingly, the movement of the mass is subject to oscillations owing to the repeatedly occurring acceleration pressures.

It is known that by means of a return-side throttling of the pressure medium flow rate a back pressure may be generated which prevents an advance of the mass and thus provides for the desired stability of control. This throttling is customarily achieved when a drain control groove adapted to the supply control groove generates a backup pressure which may have various levels depending on the pressure medium flow rate.

It is a problem that at a very small pressure medium flow rate, a harmonization of the drain cross-section with the supply cross-section is very difficult to achieve due to the very small opening cross-sections, so that the oscillations mentioned at the outset may again occur at low velocities.

In contrast, the invention is based on the object of furnishing a hydraulic controller arrangement whereby a control of consumers without oscillations is possible even at low pressure medium flow rates.

This object is achieved through a hydraulic controller arrangement having features including a pressure medium supply of a hydraulic consumer whereby a load having a high mass may be moved.

In accordance with the invention, in the drain of a hydraulic consumer a drain backup valve is arranged whereby a drain branch line leading to the tank may be controlled open before or during the opening of the drain cross-section. For example, in a first stroke range of a regulator of a directional control valve of the hydraulic controller arrangement the returning pressure medium is conducted not via a drain control groove of the regulator but via the cross-section opened by the drain backup valve which assumes the function of throttling the return quantity. The drain backup valve may very easily be adapted to the low pressure medium flow rates, so that it is possible to control consumers at low velocities without the occurrence of oscillations.

In a particularly preferred variant, a shut-off means or the like is provided downstream or upstream of the drain backup valve, whereby the drain branch line may be shut off during a predetermined stroke of the regulator of the directional control valve. Thus it is ensured that, e.g., in the closed position of the regulator or during an initial stroke, the drain backup valve may open the drain cross-section, so that control of the consumer is achieved solely through the intermediary of the cross-sections that are opened or closed, respectively, by the regulator.

In a particularly compact embodiment, these shut-off means for shutting off the drain branch line means are integrated into the directional control valve and formed by a control edge of the regulator of this directional control valve.

The construction of the control arrangement may be simplified further if the backup valve and the drain branch line are also integrated into the directional control valve, preferably in the regulator thereof.

In an embodiment having a particularly simple construction, the drain backup valve is formed by a closing body biased against a valve seat by a spring, such as a sphere.

In the known solutions, the load pressure is tapped at the associated consumer through the intermediary of a load reporting passage extending through an end portion of the regulator. In such constructions it is advantageous if this load reporting passage and a part of the drain branch line extending in the regulator are arranged in the regulator in parallel and laterally staggered relative to the valve axis.

As an alternative for this solution, it is also possible to insert a sleeve in the regulator, in the axis of which the drain branch line extends, while the load reporting passage is formed by one or several longitudinal grooves provided at the outer periphery of the sleeve.

In the case of double-action consumers, a drain backup valve may be associated to each work port of the directional control valve.

Further advantageous developments of the invention are subject matter of further subclaims.

In the following, preferred embodiments of the invention shall be explained in more detail by referring to schematic drawings, wherein.

DETAILED DESCRIPTION OF THE INVENTION

Figure 1:
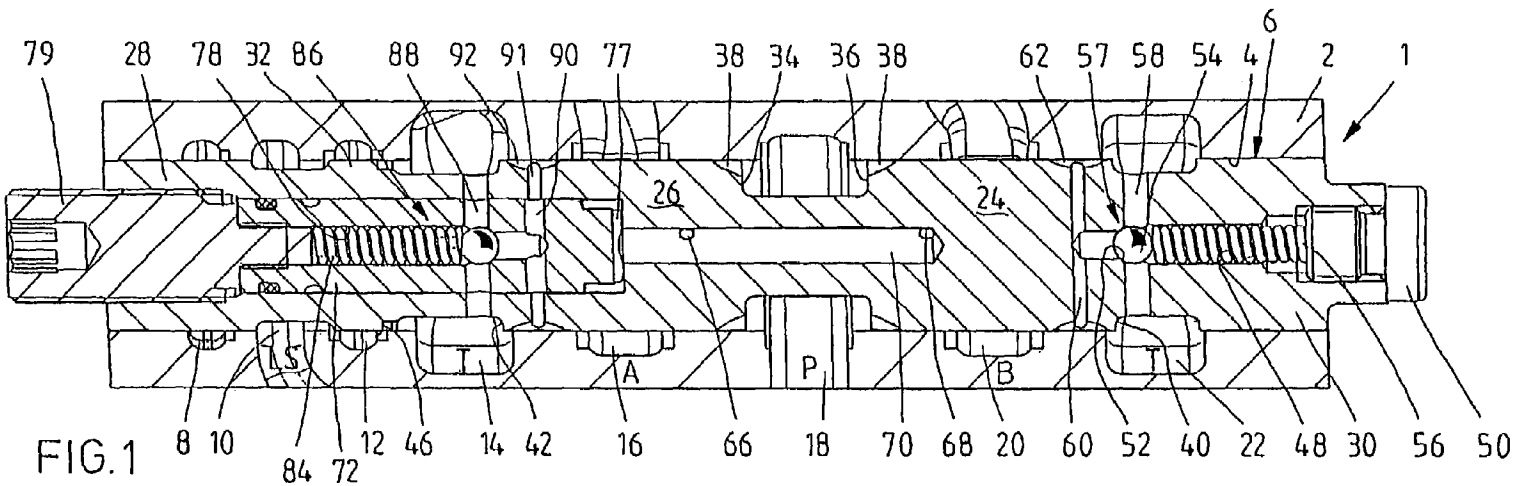
FIG. 1 is a longitudinal sectional view of a first embodiment of a proportionally adjustable directional control valve with a drain backup valve for an LS control arrangement.

In FIG. 1, a longitudinal sectional view of a continuously adjustable directional control valve 1 of an LS control arrangement is represented. With the aid of this directional control valve 1, on the one hand a meter-in orifice is formed whereby the pressure medium flow rate to the consumer is adjusted. Moreover, this directional control valve determines the direction of the pressure medium flow to and from the consumer and thus its direction of movement. The meter-in orifice is preceded or followed by an individual pressure compensator: in the case of pressure compensators arranged downstream, this is referred to as an LUDV ("load-independent flow distribution") system, and in the case of pressure compensators arranged upstream, this is referred to as a conventional LS system which does not enable a load-independent flow distribution (LUDV). The LUDV control constitutes a special case of an LS control. As will be explained in more detail later, in the event of low pressure medium flow rates the pressure medium draining from the consumer is in accordance with the invention throttled via a drain backup valve 57, 86 so as to avoid pressure fluctuations.

The directional control valve 1 represented in FIG. 1 is received in a valve disc 2 of a valve block of a mobile equipment, e.g., excavator. The valve disc 2 has a valve bore 4 where a regulator 6 is biased into a neutral position by means of valve springs (not shown) acting on an end face thereof. On the valve disc 2 a pressure port P, two work ports A, B, a tank port T, and an LS port LS are formed. The valve bore 4 is radially expanded into annular chambers (from left to right in FIG. 1) 8, 10, 12, 14, 16, 18, 20 and 22, wherein the annular chambers 8, 10, 12 are control oil chambers, the two annular chambers 14 and 20 are tank chambers, the annular chamber 18 is a pressure chamber, and the chamber 16 is a consumer chamber and the chamber 20 also is a consumer chamber, that are associated to the LS port (control oil chambers 8, 10 and 12), the tank port (tank chambers 14, 22), the work ports A, B (drain chamber 16, delivery chamber 20) and the pressure port P (pressure chamber 18).

The regulator 6 has axially spaced-apart control grooves whereby two control collars 24 and 26 formed in the center range, two end-side guide collars 28 and 30, and a tank collar 32 are formed.

At the mutually facing annular end surfaces of the control collars 24 and 26, control edges 34 and 36 are formed which are provided with respective fine control notches 38. By means of these control edges 34 and 36 it is possible to open the connection from P to A and from P to B, respectively, during the axial displacement of the regulator 6. In the represented neutral position of the regulator this connection is blocked.

Figure 2:
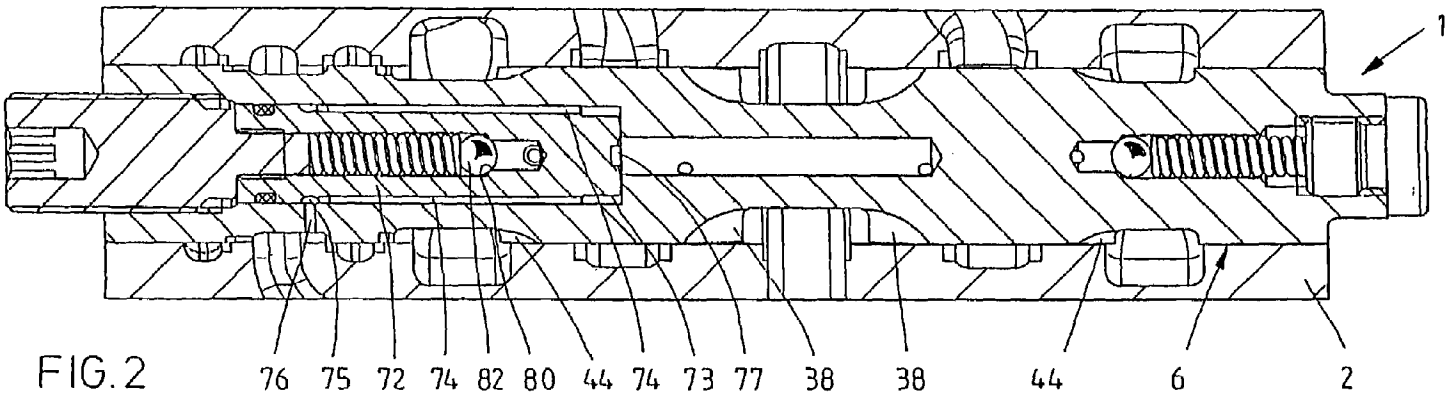
FIG. 2 is a longitudinal sectional view in accordance with FIG. 1 with a regulator of the directional control valve that is rotated by 90 degrees in comparison with FIG. 1.

At the respective external annular end surfaces of the control collars 24 and 26, tank control edges 40 and 42 are arranged that are also provided with fine control notches 44 (see FIG. 2). In the represented neutral position the connection from T to A and from T to B, respectively, is blocked by the tank control edges 40 and 42.

The tank collar 32 has an LS control edge 46 whereby the connection from the tank chamber 14 to the control oil chamber 12 may be controlled open and closed. In the represented neutral position this connection is open.

In the right-hand end portion of the regulator 6 (view of FIG. 1) an axial bore 48 is provided in the end face, which is blocked by a screw plug 50. This axial bore 48 is stepped back into a valve seat 52 against which a sphere 54 is biased by a spring 56. Hereby the connection between a transverse bore 58 and a transverse bore 60 into which the axial bore 48 opens may be shut off. The transverse bore 60 in turn opens into control grooves 62 formed at the outer periphery of the control collar 24. In the represented neutral position these shut off the connection between the tank chamber 22 and the delivery chamber 20 while being open towards the tank chamber 22, so that the sphere 54 is subjected to tank pressure on all sides and biased against its valve seat 52.

The sphere 54 which is biased against the valve seat 52 forms a drain backup valve 57 whereby—as shall be explained in more detail in the following—a drain cross-section towards the tank T may be opened following a small displacement of the regulator 6.

Inside the control collars 24 and 26, LS radial bores 66 and 68 are formed which extend through them in a radial direction and open into an axially extending LS passage 70 having the form of a blind bore and terminating in the range of the LS radial bores 68. The LS passage 70 is expanded to the left into a reception bore into which a sleeve 72 is inserted.

The sleeve 72 is provided at its upper and lower peripheral ranges in FIG. 2 with a respective longitudinal groove 74, which extends towards an annular groove 75 towards which an LS bore 76 of the regulator 6 is open. On the right-hand end face of the sleeve 72 (view of FIG. 1) a turned groove 73 and front-end recesses 77 are formed whereby the longitudinal grooves 74 are connected with the LS passage 70, so that in the event of a displacement of the regulator 6 from the represented neutral position, the load pressure prevailing in the consumer chamber 16 or in the consumer chamber 20, respectively, may be reported via the LS radial bores 66 and 68, respectively, the LS passage 70, the longitudinal grooves 74, and the LS bore 76 into the control oil chamber 10 that communicates with the LS port.

The sleeve 72 is closed at the end face by a screw plug 79 and fixed in the axial direction in the bore 78.

Inside the sleeve 72—similar to the right-hand end portion of the regulator 6—an axially extending bore 78 is provided that is stepped back to the right into a valve seat 80 against which a sphere 82 is biased by means of a spring 84. The sphere 82 which is biased against the valve seat 80 forms a second drain backup valve 86. The screw plug 79 supports the spring 84 by a projection that protrudes into the bore 78.

The portion of the bore 78 receiving the spring 84 is connected via a transverse passage 88 extending through the regulator 6 and the sleeve 72 with the tank chamber 14. The radially set-back portion of the bore 78 disposed beyond the valve seat 80 communicates via a transverse bore 90, radial bores 91 in the regulator, and control grooves 92 disposed at the outer periphery of the regulator 6 with the tank chamber 14 (neutral position) or with the consumer chamber 16. The control grooves 92 may open the connection from the delivery pressure chamber 16 towards the drain backup valve 86.

Figure 3:
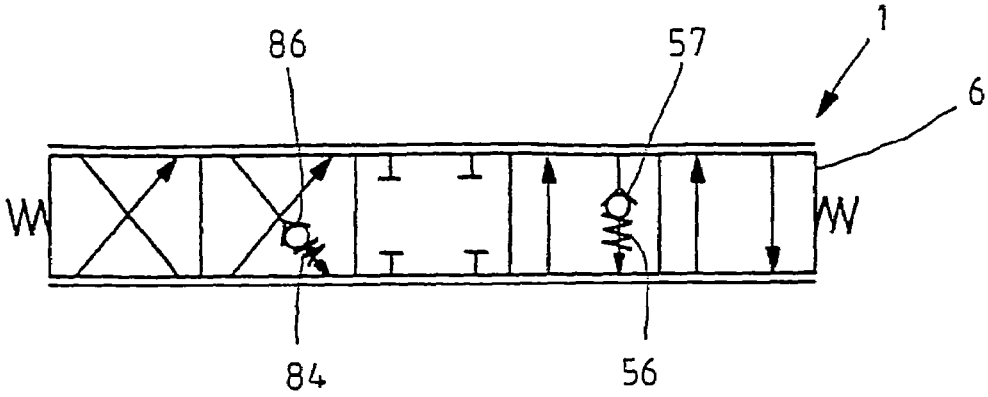
FIG. 3 shows a switching symbol of the directional control valve of FIG. 1.

FIG. 3 represents the hydraulic switching symbol of the directional control valve 1 explained by referring to FIG. 1. In its spring-biased basic position the work ports A and B are blocked relative to the pressure port P and the tank port T. Upon a displacement of the regulator 6 from the represented neutral position to the left, the connection of the pressure port P with the work port A may be opened so that the pressure chamber of the consumer that is connected to port A is supplied with pressure medium. The pressure medium draining from the consumer is initially returned, upon a slight axial displacement of the regulator 6, via the work port B and the drain backup valve 57 opened against the force of the spring 56 to the tank port T, so that the pressure medium quantity returning from the consumer is throttled by this drain backup valve 57, so that an advance of the mass moved by the consumer is prevented, and a control of the consumer without oscillations is ensured.

During a further axial displacement of the regulator 6 to the left, throttling of the return quantity is achieved by means of a drain control edge of the directional control valve 1—upon an axial displacement to the left, this drain control edge is formed by the tank control edge 40 whereby the connection from B to T is opened.

Correspondingly, upon a displacement of the regulator 6 to the right, the drain backup valve 86 initially throttles the pressure medium flow; following a further axial displacement of the regulator to the right in FIGS. 1 and 2, throttling of the return quantity is effected by means of the tank control edge 42 of the control collar 26 whereby the connection from port A to port T is opened.

For an enhanced understanding, these pressure medium flows shall once more be explained by referring to FIGS. 1 and 2.

In the neutral position the work ports A and B are blocked relative to the pressure port P and the tank port T. The drain backup valves 57 and 86 are subjected to the tank pressure in the opening direction and are urged by the force of the spring against the valve seat 52 and 80.

During a shift of the regulator 6 to the right, initially the connection from P to B is opened through the intermediary of the fine control notches 38 (meter-in orifice), so that the consumer is supplied with pressure medium via the work port B. Following an initial stroke of the regulator 6, the control groove 92 is opened towards the consumer chamber 16 and closed towards the tank chamber 14, so that the drain backup valve 86 is subjected in the opening direction to the pressure in the pressure medium return, i.e., in the consumer chamber 16. The drain backup valve 86 opens when the pressure in the consumer chamber 16 has reached the pressure equivalent of the spring 84 (e.g., 15 bar). When such an event occurs the pressure medium flow draining from the consumer is backed up correspondingly, and the draining pressure medium quantity is throttled. While the drain backup valve 86 is open, the pressure medium flows across the cross-section of flow opened by the control groove 92 and the opened drain control valve 86 from the consumer chamber 16 into the tank chamber 14 and from there to the tank port T.

As was mentioned above, the control groove 92 only opens the connection to the drain backup valve 86 after a certain stroke, so that in the neutral position of the directional control valve 1 the consumer is prevented from beginning to move by itself. This might take place, for instance, whenever an excavator is stationed on a slope and the rotating gear attempts to rotate downwards, i.e. in the downhill direction, owing to its own weight.

In the course of a further shift of the regulator 2, the meter-in orifice is opened further, whereby the pressure medium flow rate and thus the velocity of the consumer are increased correspondingly. Following further opening of the connection with the drain backup valve 86, the connection from the consumer chamber 16 into the tank chamber 14 is opened via the fine control notches 44 of the tank control edge 42, so that the drain cross-section opened by the tank control edge 42 now assumes the function of throttling the draining pressure medium quantity. The drain backup valve 86 remains opened.

The load pressure at the consumer is reported via the LS radial bore, the LS passage, the front-end recess 77, the turned groove 73, the longitudinal grooves 74, the annular groove 75, and the LS bore 76 into the control oil chamber 10.

When the regulator 1 is moved back, the drain cross-section is initially closed by the control edge 42, after which drain throttling takes place in the afore-described manner by backing up the draining pressure medium by means of the drain backup valve 86. Following a further partial stroke, the control groove 92 closes its connection towards the consumer chamber 16, with the control groove 92 opening towards the tank chamber 14 and tank pressure accordingly prevailing at the drain backup valve 86, so that the latter is returned into its closed position.

During an axial displacement of the regulator 6 from the neutral position in FIG. 1 to the left, the connection from the pressure chamber 18 to the drain chamber 16 is opened. As a result, the meter-in orifice is then determined by the supply cross-section opened by the control edge 34. The pressure medium drain from the consumer is determined after a small initial stroke, in the afore-described manner. This initially occurs because of the effect of the drain backup valve, 57 and following the further partial stroke by the drain cross-section opened by the control edge 40 and the associated fine control notches 44.

In the aforementioned variant, the drain backup valve 86 is integrated into the sleeve 72 that is inserted into the regulator 6, and the LS passage 70 is executed in alignment therewith.

Figure 4:
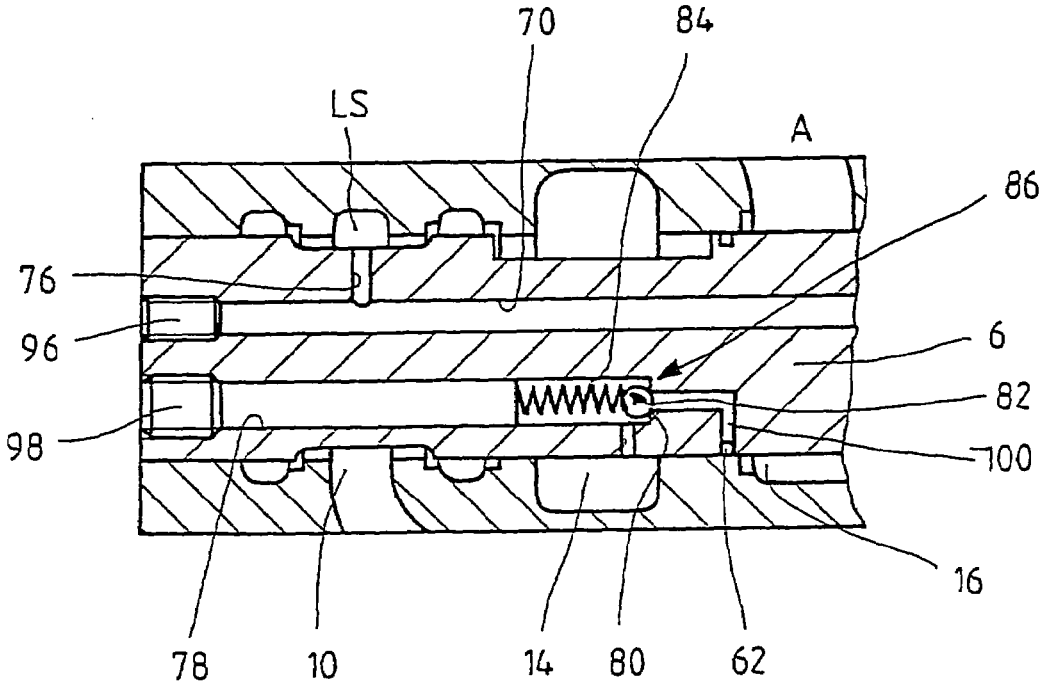
FIG. 4 is a partial view of a directional control valve of another embodiment of an hydraulic controller arrangement.

FIG. 4 represents a variant wherein the LS passage 70 is formed by a bore staggered in parallel relative to the regulator axis and closed at the end face by a screw plug 96. At a parallel distance from it, the bore 78 with the valve seat 80 for the sphere 82 of the drain backup valve 86 is disposed in the end portion of the regulator 6. The bore 78 is also closed at the end face by a screw plug 98. The bore 80 is then connected with the annular control groove 62 via an angular passage 100. For the rest, the regulator 6 of FIG. 4 substantially corresponds to the one of FIGS. 1 and 2.

The embodiment represented in FIG. 4 has a somewhat more simplistic structure in terms of apparatus, however is somewhat more complex to execute during manufacture because the introduction of the staggered bores and of the angular passage 100 making it more difficult to perform in comparison to when it is in the solution, where the routing of passages is substantially integrated into the sleeve 72.

What is disclosed is a hydraulic controller arrangement for the pressure medium supply of a hydraulic consumer, which may be used on the rotating gear of a mobile work machine. At low pressure medium flow rates, the pressure medium flow rate draining from the consumer is backed up by means of a drain backup valve having the form of a pressure limiting valve and it is throttled accordingly, so that a back pressure is generated which is capable of preventing an advance of the mass actuated by the hydraulic consumer.

The invention claimed is:

1. A hydraulic controller arrangement for pressure medium supply of a hydraulic consumer whereby a load having a high mass may be moved, the hydraulic controller arrangement comprising:

a pump which may be controlled dependent upon a load pressure at the consumer;

a proportionally adjustable directional control valve, wherein the pressure medium may be conducted via the proportionally adjustable directional control valve to the consumer and from the consumer to a tank passage via a drain cross-section controlled to be opened by a drain control edge of the directional control valve;

a pressure limiting valve disposed in a pressure medium flow path between the consumer and the tank passage, the pressure limiting valve being subjected in its opening direction to pressure in a pressure medium return, whereby it is possible to open a drain branch line leading to the tank passage substantially prior to opening of the drain cross-section.

2. The hydraulic controller arrangement of claim 1, wherein shut-off means for blocking the drain branch line during a predetermined stroke of a regulator of the directional control valve are provided in the drain branch line upstream or downstream from the limiting valve.

3. The hydraulic controller arrangement of claim 2, wherein the shut-off means are formed by a control edge of the regulator.

4. The hydraulic controller arrangement of claim 3, wherein the control edge is formed by a control groove into which a radial bore of the drain branch line merges.

5. The hydraulic controller arrangement of claim 2, wherein the pressure limiting valve comprises a valve body that is biased against a valve seat.

6. The hydraulic controller arrangement of claim 1, wherein the limiting valve and the drain branch line are integrated into a regulator of the directional control valve.

7. The hydraulic controller arrangement of claim 6, wherein the pressure limiting valve is arranged in a sleeve inserted into the regulator, at the outer periphery of which a load reporting passage extends which is formed in portions thereof by a longitudinal groove.

8. The hydraulic controller arrangement of claim 6, wherein the pressure limiting valve is arranged in a portion of the drain branch line extending in parallel with a load reporting passage, with the portion of the drain branch line and/or the load reporting passage extending at a parallel spacing from the regulator axis.

9. The hydraulic controller arrangement of claim 1, wherein the directional control valve has two work ports A, B, and to each work port one pressure limiting valve is associated.

* * * * *